US005989038A

United States Patent [19]

Jesman et al.

[11] Patent Number: 5,989,038

[45] Date of Patent: Nov. 23, 1999

[54] COAXIAL ELECTRICAL CONNECTOR

[76] Inventors: Andrew Jesman, Highdown Longdown Road, Guildford, Surrey, United Kingdom, GU4 8PP; Christopher Jesman, Westhaven, 6 Rosebriars, Esher, Surrey, United Kingdom, KT10 9NN

[21] Appl. No.: 09/068,885

[22] PCT Filed: Nov. 26, 1996

[86] PCT No.: PCT/GB96/02906

§ 371 Date: May 22, 1998

§ 102(e) Date: May 22, 1998

[87] PCT Pub. No.: WO97/20364

PCT Pub. Date: Jun. 5, 1997

[30] Foreign Application Priority Data

Nov. 28, 1995 [GB] United Kingdom ..... 9524316

[51] Int. Cl.[6] ..... H01R 9/09

[52] U.S. Cl. ..... 439/63; 439/581

[58] Field of Search ..... 439/63, 581, 579, 439/76.1, 79

[56] References Cited

U.S. PATENT DOCUMENTS

| | | | |
|---|---|---|---|
| Re. 36,065 | 1/1999 | Andrews et al. | 439/63 |
| 3,201,722 | 8/1965 | May et al. | 439/63 |
| 4,710,138 | 12/1987 | Bradley et al. | 439/63 |
| 4,857,017 | 8/1989 | Erk | 439/79 |
| 5,046,952 | 9/1991 | Cohen et al. | 439/63 |
| 5,062,811 | 11/1991 | Hackman | 439/581 |
| 5,842,872 | 12/1998 | Hosler et al. | 439/63 |

*Primary Examiner*—Khiem Nguyen
*Assistant Examiner*—T C Patel
*Attorney, Agent, or Firm*—Jacobson, Price, Holman & Stern, PLLC

[57] ABSTRACT

An electrical connector (1) is to be attached to a circuit board (34) to establish a connection between the board (34) and a coaxial cable. The connector (1) has an outer connector portion (38) formed in a housing (36), and a central conductor element (8) having two limbs (18, 22) joined by an elbow. An insulator assembly comprising a pair of insulating members (2, 4) encloses the central conductor element (8) in the region of the elbow. One limb (18) of the central conductor (8) is located by the assembly in coaxial relationship with the outer connector portion (38) of the housing (36) for engagement with an inner conductor of the cable. The other limb (22) is presented for attachment to the circuit board (34).

13 Claims, 4 Drawing Sheets

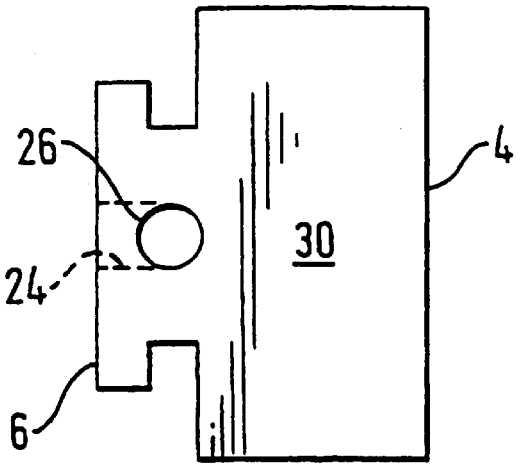
FIG. 4
FIG. 5
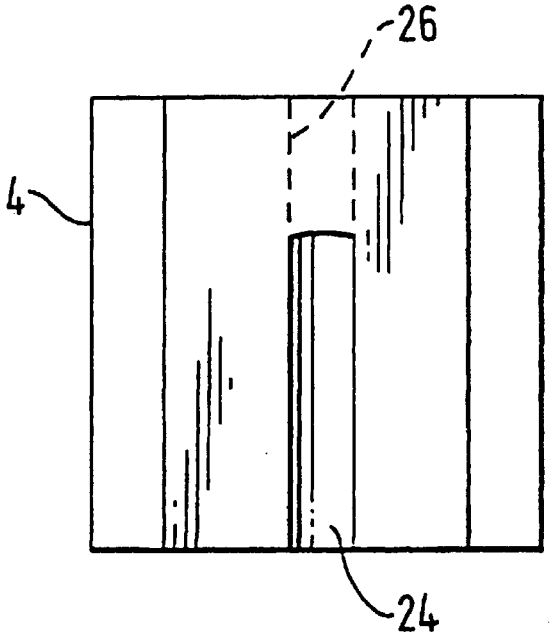
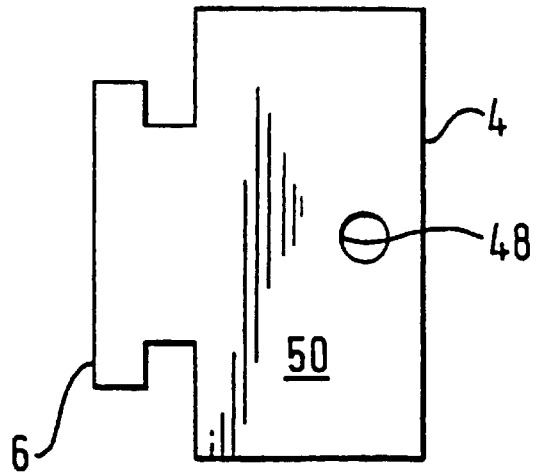
FIG. 6

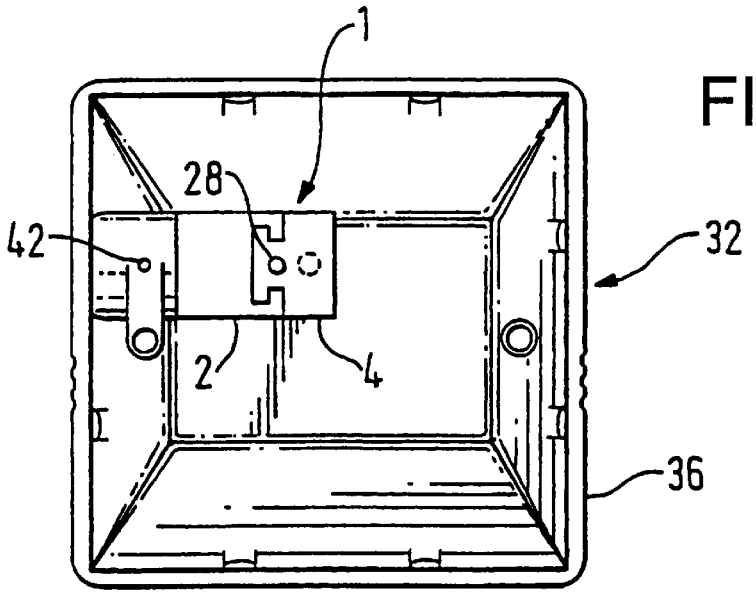
FIG. 7
FIG. 8
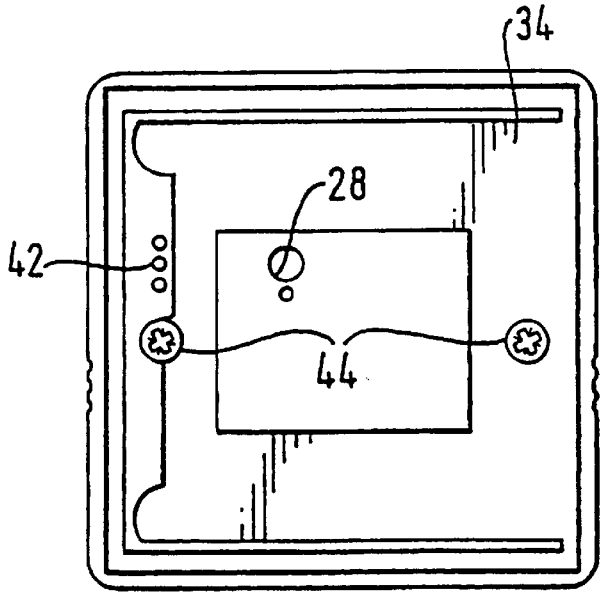
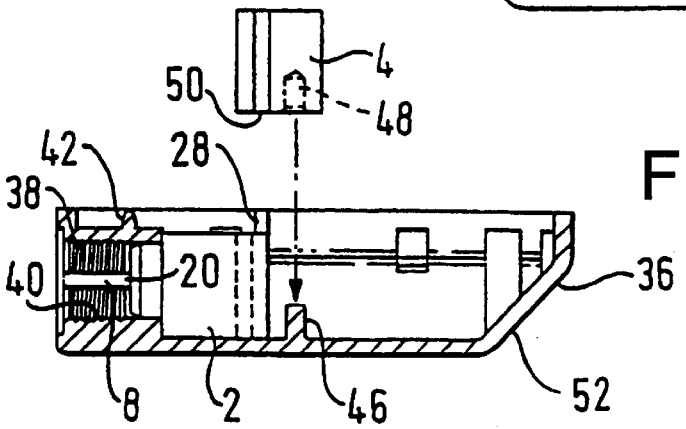
FIG. 9

COAXIAL ELECTRICAL CONNECTOR

BACKGROUND OF THE INVENTION

1. Field of the Invention

The present invention relates to an electrical connector, for connecting a cable to a circuit board.

2. Description of Related Art

A cable such as a RF coaxial cable forming an antenna lead, for example, may be connected to a circuit board either through direct soldered connections to the inner and outer conductors or, where a non-permanent connection is desired, via a terminating connector on the cable which is insertable into a suitable receptacle connector soldered to the board. The former type of connection suffers from the disadvantage that the connection is permanent and is difficult to repair particularly where the connection is made to a larger assembly, whereas the latter type presents difficulties in achieving reliable connections, particularly where good grounding is required. In either case the assembly of a component incorporating either type of connection is time consuming, difficult and consequently expensive to perform.

SUMMARY OF THE INVENTION

It is therefore an object of the present invention to provide an improved electrical connector which overcomes the disadvantages of the prior art and in particular which is inexpensive and simple to construct.

According to the present invention, there is provided an electrical connector for attachment to a circuit board to establish a connection between said circuit board and a coaxial cable connector, comprising an electrically conductive housing for attachment to said circuit board and including an outer connector portion for engagement with an outer conductor portion of said cable connector, a central conductor element having two limbs joined by an elbow, and an insulator assembly comprising a plurality of members of insulating material shaped for interengagement to enclose said central conductor element in the region of said elbow, the said housing being so arranged to receive said insulator assembly and the central conductor element that with one limb of said central conductor located by said assembly in coaxial relationship with said outer connector portion of the housing for engagement with an inner conductor of said cable connector, the other limb is presented for attachment to the circuit board.

Preferably, a pair of insulating members are shaped for sliding interengagement to enclose respectively the limbs of the central conductor. Advantageously, the insulating members are shaped such that in order to facilitate retention of the assembly by the housing, one member must first be located by the housing whilst the other member is slidingly engaged thereon. The insulating members may be formed with surfaces which are flush with the surface of the circuit board when engaged in order that the assembly is held by the board against disengagement.

BRIEF DESCRIPTION OF THE DRAWINGS

In order to more fully understand the invention, a specific embodiment thereof will now be described by way of example and with reference to the accompanying drawings, in which:

FIG. 4 is a plan view of board mating insulator block of a connector according to the invention;

FIG. 5 is a front elevation of the insulator block of FIG. 4;

FIG. 6 is an underside view of the insulator block of FIG. 4;

FIG. 7 is an underside view of a partially assembled antenna matching element showing the assembled connector in position thereon;

FIG. 8 is a similar view to that of FIG. 7 showing a fully assembled matching element; and FIG. 9 is a cross-sectional side view of the element of FIG. 7 at an intermediate stage in the assembly of the connector thereon.

DETAILED DESCRIPTION OF THE PREFERRED EMBODIMENTS

Figure 1:
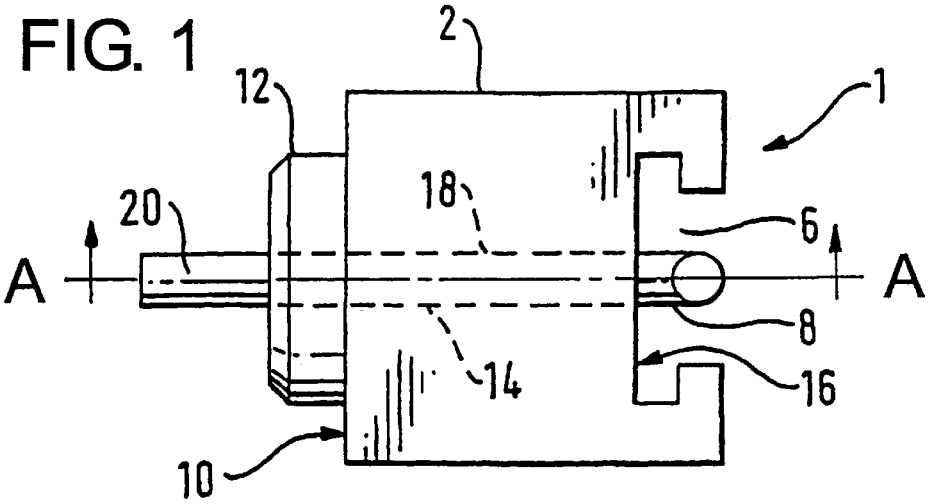
FIG. 1 is a plan view of a cable mating insulator block of a connector according to the invention, shown with a central conductor inserted therein.
Figure 2:
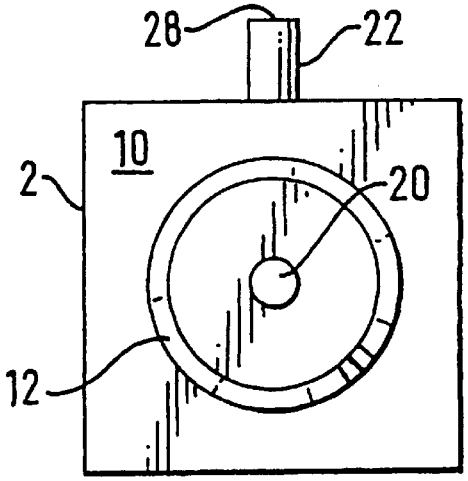
FIG. 2 is a front elevation of the insulator block of FIG. 1, again showing the central conductor.
Figure 3:
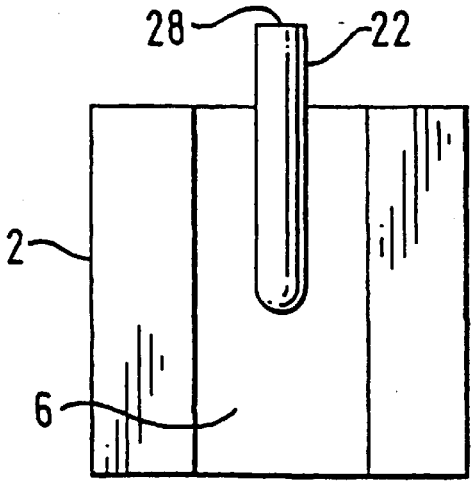
FIG. 3 is a rear elevation of the insulator block of FIG. 1, showing the central conductor.

The connector 1 shown in the figures comprises first and second insulator members or blocks 2,4 which when assembled utilising a dove-tail or similar connection 6 house an L-shaped conductor 8 made from a suitable material e.g. tin-plated mild steel, copper or the like, which forms a conductive pathway between an RF antenna lead (not shown) and a printed circuit board (not shown), for example. One face 10 of the first insulator block 2 is provided with a suitable moulding 12 to receive the end of an antenna lead or the like. An axial bore 14 passes through the first insulator block 2 between the one face 10 and its opposing face 16, which face 16 forms one half of the dove-tail connection 6 to the second block 4. One limb 18 of the conductor 8, when inserted in the bore 14 of the first block 2, provides a central contact pin 20 for an inner conductor of the antenna lead which is concentric with the moulding 12, whilst the other limb 22 emerges from the first block 2 at right angles to the axial bore 14 and is received by a groove 24 and coaxial bore 26 formed in the second block 4 such that its free end portion 28 projects slightly from a circuit board contact face 30 of the block 4. The projecting portion 28 may then be received in a preformed through-tinned hole (not-shown) in the circuit board by which means an electrical connection is made to the circuit board.

Figure 10:
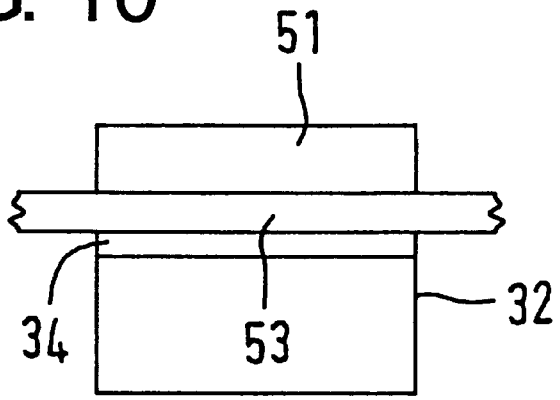
FIG. 10 is a block diagram of an antenna matching circuit with a glass mount antenna.
Figure 11:
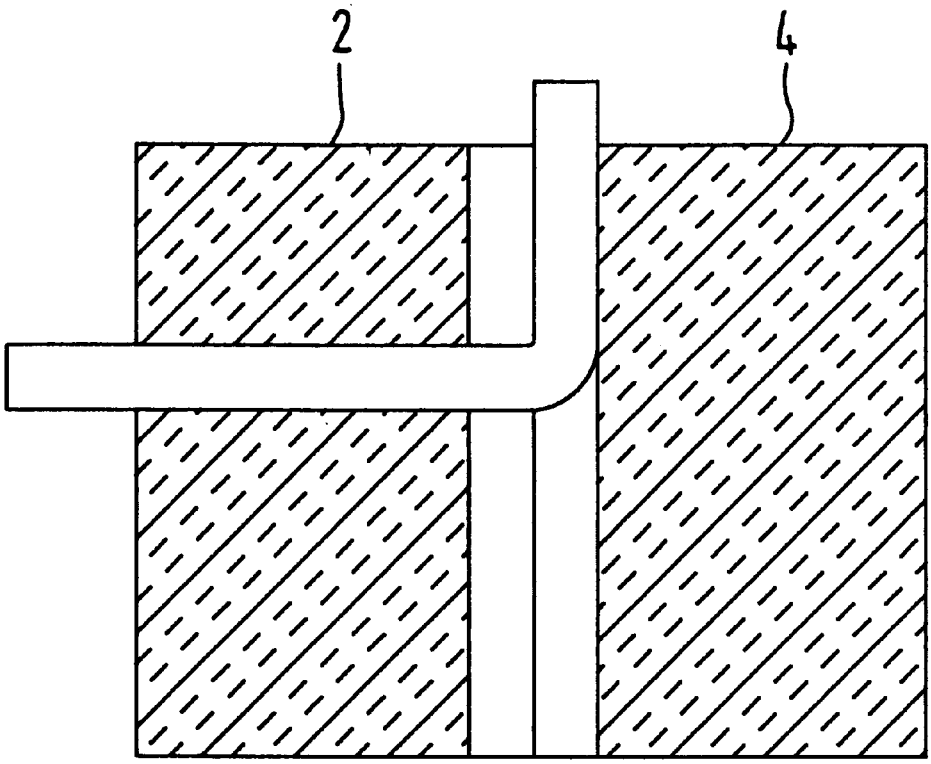
FIG. 11 is a cross section taken along line A—A of FIG. 1.

It will be appreciated that the connector 1 has applications wherever provision must be made for attaching, a lead or the like to an electrical circuit contained within a housing or enclosure. For example, FIGS. 7, 8 and 9, in which the same reference numerals are utilised to indicate corresponding parts, show an antenna matching element 32 for a glass-mount antenna 51 (FIG. 10). Such antennae are well-known and generally comprise a radiating antenna element 51 adhesively secured to the exterior of a glass screen 53 A coupling pad or circuit board 34 adhesively secured to the interior of the screen in facing relationship to the antenna element 51 provides capacitative coupling through the overlapping conductive plates arranged externally and internally of the glass screen 53. In addition, the coupling pad or circuit board 34 provides impedance matching between the antenna and a conventionally terminated 50 ohm coaxial cable (not shown).

In order to provide both shielding and capacitance, the element's enclosure 36 may be conductive in its entirety, or alternatively as shown in FIG. 9, a non-conductive material may be suitably coated with conductive material 52. In order to ensure a good earth connection between the enclosure 36 and the outer conductor of the coaxial cable, the enclosure 36 is cast or moulded with an aperture 38 having a suitable internal thread 40 which receives the terminated cable. Additional earth connections between the enclosure 36 and the relevant portion of the pad or circuit board 34 are made by a small pip 42 formed on the enclosure 36 and by the screws 44 which fasten the pad or board 34 to the enclosure 36.

The inner conductor of the cable is electrically connected to the pad or circuit board via the coupler 1 which is fitted to the enclosure 36 in a two-step process. Firstly, the first block 2 is inserted into the aperture 38 for the cable, the conductor 8 having been pre-inserted in the axial bore 14, and only then is the second block 4 brought into sliding engagement with the first block 2 such that the end portion 28 of the conductor 8 protrudes slightly from the connector 1 as previously described. It will be appreciated that the connector 1, once assembled on the enclosure 36 cannot easily become separated from the enclosure 36 and is ready to receive the circuit board 34. In addition to the aperture 38 which helps to locate the connector 1 within the enclosure 36, (referring to FIGS. 6 and 9) a boss 46 formed on the interior surface of the enclosure 36 cooperates with a complementary recess 48 formed in an enclosure contacting face 50 of the second block 4. A positive electrical contact to the pad or board 34 is obtained by soldering the projecting portion 28 of the conductor 8 to the pad or circuit board 34 by which means the central conductor of the terminated cable may be electrically connected to the relevant part of the board 34.

We claim:

1. An electrical connector for attachment to a circuit board to establish a connection between said circuit board and a coaxial cable connector, comprising an electrically conductive housing for attachment to said circuit board and including an outer connector portion for engagement with an outer conductor portion of said cable connector, a central conductor element having first and second limbs joined by an elbow, and an insulator assembly comprising a plurality of members of insulating material shaped for slidable interengagement in a direction substantially normal to a longitudinal axis of the first limb to enclose said central conductor element in the region of said elbow, said housing being arranged to receive said insulator assembly and the central conductor element such that the first limb of said central conductor is located by said insulator assembly in coaxial relationship with said outer connector portion of the housing for engagement with an inner conductor of said coaxial cable connector, and the second limb is presented for attachment to the circuit board.

2. A connector as claimed in claim 1, in which said insulator assembly comprises a pair of slidingly interengagable blocks each of which receives a respective one of said limbs.

3. A connector as claimed in claim 1, in which the housing is formed of conductive material.

4. A connector as claimed in claim 1, in which the housing is substantially non-conductive and has a conductive coating applied thereto.

5. A connector as claimed in claim 2, in which one of said pair of blocks is provided with a bore which extends between opposing faces thereof, and which bore receives the first limb of said central conductor such that an extremity of said the first limb protrudes from one of said faces.

6. A connector as claimed in claim 2, in which one of said pair of blocks is provided with a recess for an elbow of said element and a bore extending from said recess to an exposed face of said block which bore receives the second limb of said central conductor.

7. A connector as claimed in claim 5 wherein the extremity of said first limb is in coaxial relationship with said outer connector portion of the housing for engagement with an inner conductor of said cable connector.

8. A connector as claimed in claim 5, wherein an extremity of second said limb is presented for attachment to the circuit board.

9. A connector as claimed in claim 1, wherein an extremity of said first or second limb extends substantially normal to the plane of the board.

10. A connector as claimed in claim 1, in which the enclosure and a member of said insulator assembly are provided with complementary engagable formations.

11. A connector as claimed in claim 10, wherein the complementary formations comprise a boss formed on the enclosure which is engagable with a recess formed in said member.

12. An antenna matching element comprising a radiating antenna element, securable, in use, to an external surface of a glass screen, and a connector as claimed in claim 1 capacitively coupled via said circuit board, the arrangement being such that the circuit board is adhesively secured to an interior surface of said glass screen in facing relationship to the antenna element to provide said capacitive coupling, said circuit board additionally providing impedance matching between the antenna and said coaxial cable connector.

13. The connector of claim 1, wherein the insulator assembly provides rigid support to the central conductor element.

* * * * *